US006948461B1

(12) United States Patent
Kotwicki

(10) Patent No.: US 6,948,461 B1
(45) Date of Patent: Sep. 27, 2005

(54) ELECTROMAGNETIC VALVE ACTUATION

(75) Inventor: Allan J. Kotwicki, Williamsburg, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/838,902

(22) Filed: May 4, 2004

(51) Int. Cl.[7] ..... F01L 9/04

(52) U.S. Cl. ..... 123/90.11; 123/90.15; 123/90.24; 251/129.07; 251/129.09; 251/129.15; 251/129.16; 251/129.18; 335/266; 335/268; 335/269; 361/159; 361/189

(58) Field of Search ..... 123/90.11, 90.15, 123/90.24; 251/129.07, 129.09, 129.15, 129.16, 251/129.18; 335/220, 266, 268, 269; 361/159, 361/189, 301.1, 328; 323/259, 344

(56) References Cited

U.S. PATENT DOCUMENTS

| | | | | |
|---|---|---|---|---|
| 3,896,346 | A | 7/1975 | Ule | |
| 5,532,526 | A * | 7/1996 | Ricco et al. | 307/104 |
| 5,717,562 | A | 2/1998 | Antone et al. | |
| 5,815,365 | A | 9/1998 | Stege | |
| 5,883,776 | A | 3/1999 | Keegan et al. | |
| 5,952,738 | A | 9/1999 | Miller | |
| 6,005,763 | A | 12/1999 | North | |
| 6,050,281 | A | 4/2000 | Adams et al. | |
| 6,123,058 | A | 9/2000 | Endou | |
| 6,140,717 | A | 10/2000 | Fischer et al. | |
| 6,234,122 | B1 * | 5/2001 | Kirschbaum et al. | 123/90.11 |
| 6,324,046 | B1 | 11/2001 | Kadah | |
| 6,363,895 | B1 | 4/2002 | Butzmann et al. | |
| 6,397,797 | B1 * | 6/2002 | Kolmanovsky et al. | 123/90.11 |
| 6,741,441 | B2 * | 5/2004 | Hilbert et al. | 361/160 |
| 6,772,737 | B2 * | 8/2004 | Gaessler et al. | 123/490 |

FOREIGN PATENT DOCUMENTS

| | | | |
|---|---|---|---|
| EP | 1010867 A1 * | 6/2000 | F01L 9/04 |
| JP | 10-131726 | 5/1998 | |
| JP | 11-294123 | 10/1999 | |
| JP | 11-294124 | 10/1999 | |
| JP | 2000-110593 | 4/2000 | |
| JP | 2003-007532 | 1/2003 | |

OTHER PUBLICATIONS

Gunselmann, CH. and Melbert, J.—"Improved Robustness and Energy Consumption for Sensorless Electromagnetic Valve Train", SAE Technical Bulletin 2003-01-0030, reprinted from Variable Valve Actuation 2003 (SP-1752/SP-1752CD), Mar. 2003, 10 pages.

* cited by examiner

*Primary Examiner*—Thomas Denion
*Assistant Examiner*—Kyle M. Riddle
(74) *Attorney, Agent, or Firm*—Donald J. Lewis; David Bir

(57) ABSTRACT

A system and method for controlling an internal combustion engine provide valve actuation that selectively couples an energy storage device to a launching coil to recover energy stored in the magnetic field and valve spring of the launching coil, decouples the energy storage device during a valve opening or closing event to control energy supplied to the catching coil, and couples the energy storage device to the catching coil to transfer energy from the storage device to the catching coil to provide a repeatable soft landing. A nonlinear feedback controller incorporates a feedforward system with an observer to control the rate of energy into the magnetic field of the catching coil while compensating for system losses and work to overcome gas forces within the combustion chamber. Feedback linearization techniques improve stability of the control system.

30 Claims, 4 Drawing Sheets

ELECTROMAGNETIC VALVE ACTUATION

BACKGROUND OF THE INVENTION

1. Field of the Invention

The present invention relates to a system and method for actuation of a valve, such as an intake and/or exhaust valve of an internal combustion engine.

2. Background Art

Conventional internal combustion engines use a camshaft to mechanically actuate the intake and exhaust valves of the cylinders or combustion chambers. The fixed valve timing of this arrangement, or limited timing adjustment available for variable cam timing systems, limits control flexibility. Electronic valve actuation (EVA) offers greater control authority and can significantly improve engine performance and fuel economy under various operating conditions. Electromagnetic actuators are often used in EVA systems to electrically or electronically open and close the intake and/or exhaust valves.

Electromagnetic actuators controlled by an associated valve controller, engine controller, and/or vehicle controller may use electromagnets or solenoids to attract an armature that operates on the valve stem. In a typical electromagnetic actuator, two opposing electromagnets and associated springs are used to open and close an engine valve in response to the signals generated by the controller. The upper and lower electromagnets are energized to assist the springs in closing and opening the valve, respectively, and to hold the valve closed or open against the associated spring force. The upper spring exerts a downward force that pushes the valve downward as the upper electromagnet is turned off, while the lower spring exerts an upward force that pushes the valve upward as the lower electromagnet is turned off. The opening, closing and landing speeds of the valve are functions of a number of parameters including the spring forces and the excitation currents of the electromagnets.

For many applications it is desirable to provide fast, controlled valve actuation to improve engine performance without a significant increase in actuator power consumption, which could adversely affect fuel economy. Power consumption is affected by the speed with which current is removed from the electromagnets when releasing the armature. During release of the armature from either the upper or lower electromagnet, current to the holding electromagnet should stop quickly. Otherwise, mechanical potential energy stored in the associated spring is not converted into motion, but instead into electrical energy that must be recycled through the associated electronic circuitry, with an inevitable loss. If excessive spring energy is converted to electrical energy during the launch because of slow current quenching, the spring/armature system may not have sufficient kinetic energy to reliably move the armature within the catching region of the opposing electromagnet during the subsequent valve landing to be reliably caught.

Similarly, energy supplied to the new holding coil (or catching coil) should be controlled and supplied at a rapid rate at the appropriate time to avoid electrical resistive losses during flight while still providing controlled and reliable valve landings for repeatability and durability.

Prior art EVA control strategies have incorporated one or more capacitors in the control circuitry for energy recovery. For example, Japanese patent application 10-282974 (Pub. No. 2000-110593) published Apr. 18, 2000 discloses the use of capacitors to store energy released during shut off of a coil Lo power the same coil and/or an alternate or following coil during a subsequent energization. Similarly, U.S. Pat. No. 3,896,346 discloses a parallel or shunting capacitor to store energy recovered from one coil during de-energization to subsequently energize another coil.

Some prior art EVA control strategies have employed dual "H" bridges to separately control the two electromagnets to control valve movement. Using "H" bridges without any other associated energy storage makes power supply voltage selection difficult. If low power supply voltage is selected, the low voltage would need to be applied for a considerable period of time before holding coil magnetic energy was removed and valve motion could begin. This limits valve timing control flexibility because the control action must be determined long before actual valve motion. Furthermore, because valve motion would begin with a considerable current in the holding coil, and current would remain longer because of the low voltage, considerable conversion of mechanical to electrical energy could occur during launch. In addition, the electrical energy needed for holding would need to be inserted into the attracting coil for a longer time while also inserting energy needed to compensate for losses to friction and gas forces resulting in large coil currents and high resistive losses. Although a high voltage supply could be used to apply a high voltage for a short period of time to remove holding coil energy and add the needed holding coil energy, the high voltage supply is needed only for a short time during the launch and landing phases of armature motion. However, complex circuitry to control the high voltage supply would be present at all times. As such, selection of either a high or low voltage supply with conventional "H" bridge circuitry results in wasted energy, because regenerated energy and current flows backward through various "H" bridge components to the power supply when reverse voltage is applied to the holding coil during launch. In addition, such an arrangement requires additional "H" bridge components to allow applied coil voltage to be reversed.

SUMMARY OF THE INVENTION

The present invention provides valve actuation that selectively couples an energy storage device to a launching coil to recover energy stored in the magnetic field and valve spring of the launching coil, decouples the energy storage device during a valve opening or closing event to control energy supplied to the catching coil to overcome gas forces and losses, and couples the energy storage device to the catching coil to transfer energy from the storage device to the catching coil to provide a repeatable soft landing.

Embodiments of the present invention include a system and method for actuating and/or recovering energy during actuation of a valve having an armature coupled to a valve stem and movable between first and second electromagnets during an opening or closing event to open and close the valve, such as an intake or exhaust valve of an internal combustion engine. The opening or closing events include a launch from a first (holding) electromagnet, travel or flight of the armature across a gap between the first and second electromagnets, a catch by the second (catching) electromagnet, and a hold by the second electromagnet. The system and method selectively couple an energy storage device, which preferably includes a capacitor, to the launching electromagnet coil via one or more controllable switches, which may be implemented by transistors and/or SCRs, for example. The system and method control the switches to couple the energy storage device to the launching coil to rapidly quench the launching coil during launching or de-energization. The capacitor may then be decoupled from both coils during flight while the power supply is controlled to deliver energy to the catching coil to overcome gas forces and various losses including electrical, mechanical, and magnetic losses. The switches are then controlled to couple the energy storage device to the catching coil to generate an appropriate attractive force for the catch phase of the opening or closing event.

In one embodiment, a nonlinear feedback controller incorporates a feedforward system with an observer to control the rate of energy into the magnetic field of the catching coil while compensating for resistive losses in the coil, damping energy due to friction, and work to overcome gas forces within a combustion chamber or cylinder associated with the valve or valves. Feedback linearization techniques may be used to provide acceptable stability of the nonlinear control system.

To provide a soft launch and ameliorate the effects of various factors contributing to noise, vibration, and harshness associated with valve lash, a current catcher according to the present invention may be used in combination with a velocity controller. The velocity controller may be used to control the power supply and launch the armature across the valve lash gap during valve opening with the current catcher used to quickly capture any remaining energy in the associated energy storage device. The rate of energy into the magnetic field of the catching coil is then controlled to add an equivalent amount of energy lost during the soft launch in addition to compensating for losses as described above. The stored energy is then used or recycled to aid the catch by the opposing coil. During valve closing, there is initially no lash between the valve stem and the armature pushing pin so that the velocity controller is generally not beneficial and not used during the launch phase. Of course, depending upon the particular application, the present invention may also use the velocity controller during valve closing and armature landing where beneficial. It may be used during the valve closing landing and during the armature landing phase after the lash gap has opened. This would modify the timing of application of catching energy to the upper coil from the energy storage device.

The present invention provides a number of advantages. For example, the present invention controls a switched energy storage device, such as a capacitor, to rapidly quench the coil current during de-energization while storing the energy for use during energization of an opposing coil associated with the same valve to provide an appropriate catching current. Efficient energy recovery and reuse according to the present invention may allow use of smaller springs and smaller actuator assemblies. Controlling the rate of energy supplied to the magnetic field of the catching coil over the entire opening or closing event to overcome gas forces and electrical, magnetic, and mechanical losses, provides efficient energy use to reduce the size of the necessary power supply while providing repeatable soft valve landings under various operating conditions. In addition, by applying power to the catching coil over the entire valve opening or closing event, less energy is needed at the catch event allowing use of a lower voltage power supply, which may ultimately lead to improved fuel economy and correspondingly lower emissions.

The above advantages and other advantages and features of the present invention will be readily apparent from the following detailed description of the preferred embodiments when taken in connection with the accompanying drawings.

DETAILED DESCRIPTION OF THE PREFERRED EMBODIMENT(S)

Figure 1:
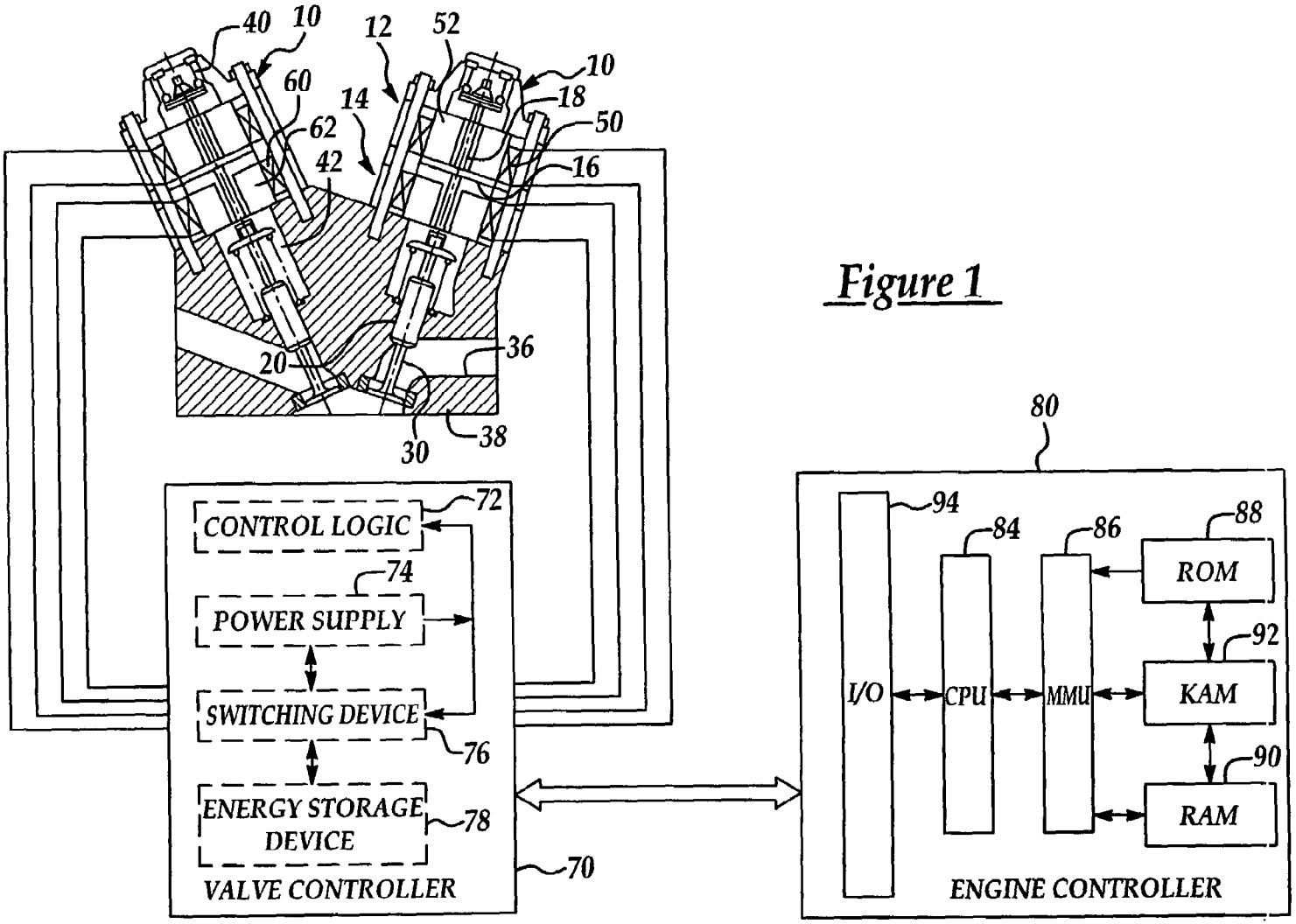
FIG. 1 is a diagram illustrating a representative application for a system or method for valve actuation according to the present invention.

Referring now to the drawings wherein like reference numerals are used to identify similar components in the various views, FIG. 1 is a cross-section illustrating one embodiment of a valve actuator assembly for an intake or exhaust valve of an internal combustion engine according to the present invention. Valve actuator assemblies 10 includes an upper electromagnet 12 and a lower electromagnet 14. As used throughout this description, the terms "upper" and "lower" refer to positions relative to the combustion chamber or cylinder with "lower" designating components closer to the cylinder and "upper" referring to components axially farther from the corresponding cylinder. Those of ordinary skill in the art will recognize that actuator assemblies 10 generally include similar components that function in a similar or identical manner but may be sized differently to operate intake or exhaust valves, for example. The present invention is independent of the particular type of valve actuation and may be applied or adapted to a variety of applications.

As illustrated in FIG. 1, an armature 16 extends between the coils of electromagnets 12, 14 radially outward from an armature shaft 18, which extends axially through a bore in upper electromagnet 12 and lower electromagnet 14, guided by one or more bushings in the electromagnet assemblies, similar to valve bushing 20. Armature shaft 18 is operatively associated with an engine valve 30 that includes a valve head and valve stem. As those of ordinary skill in the art will appreciate, various connecting or coupling arrangements other than illustrated in FIG. 1 may be used to translate axial motion of armature 16 between upper and lower electromagnets 12, 14 to valve 30 to open and close valve 30 and selectively couple intake passage 36 within an engine cylinder head 38 to a corresponding combustion chamber or cylinder.

Actuator assemblies 10 also include an upper spring 40 operatively associated with armature shaft 18 for biasing armature 16 toward a neutral position away from upper electromagnet 12, and a lower spring 12 operatively associated with valve stem 34 for biasing armature 16 toward a neutral position away from lower electromagnet 14.

Upper electromagnet 12 includes an associated upper coil 50 wound through a corresponding slot in upper core 52 encompassing armature shaft 18. Lower electromagnet 14 includes an associated lower coil 60 wound through a corresponding slot in lower core 62 encompassing armature shaft 18.

A valve controller 70 may be provided to control valve actuation, preferably by directly or indirectly controlling current supplied to upper and lower electromagnets 12, 14 according to the present invention. The various components or functions of valve controller 70 may be implemented by a separate controller as illustrated, or may be integrated or incorporated into an engine, vehicle, or other controller, such as engine controller 80, depending upon the particular application. Valve controller 70 may include control logic 72 to control power supply 74 and one or more switching devices 76 to selectively store and recover energy from one or more energy storage devices 78 as described in greater detail below. Depending upon the particular implementation, valve controller 70 may also include control logic functioning as a velocity controller using power supply 74 and switching devices 76 to provide a soft launch during valve opening. Alternatively, a separate velocity controller may be used to launch the valve during an opening event and remove any lash between armature shaft 18 and the valve stem of valve 30.

In general, to close a valve, valve controller 70 turns off current from power supply 74 supplied to lower coil 60 and controls switching device 76 to transfer energy from lower coil 60 to energy storage device 70. Bottom spring 42 will push valve 30 upward. Control logic 72 controls switching device 76 and/or power supply 74 as valve 30 approaches the closed position to energize upper coil 50 when armature 16 approaches upper core 52. The magnetic force generated by upper electromagnet 12 will catch and hold armature 16, and therefore, valve 30 in the closed position. The process is reversed to open valve 30 with current to upper coil 50 turned off and switching device 76 controlled to couple energy storage device 78 to upper coil 50. Upper spring 40 pushes armature shaft 18 and valve 30 down. Valve controller 70 then controls power supply 74 and switching device 76 to energize lower coil 60 to catch and hold valve 30 in the open position.

Controller 80 has a microprocessor 84, called a central processing unit (CPU), in communication with memory management unit (MMU) 86. MMU 86 controls the movement of data among the various computer readable storage media and communicates data to and from CPU 84. The computer readable storage media preferably include volatile and nonvolatile storage in read-only memory (ROM) 88, random-access memory (RAM) 90, and keep-alive memory (KAM) 92, for example. KAM 92 may be used to store various operating variables while CPU 84 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 84 in controlling the engine or vehicle into which the engine is mounted. The computer-readable storage media may also include floppy disks, CD-ROMs, hard disks, and the like. CPU 84 communicates with various sensors and actuators directly or indirectly via an input/output (I/O) interface 94. Interface 94 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 84. Examples of items that may be actuated under control of CPU 84, through I/O interface 94, are fuel injection timing, fuel injection rate, fuel injection duration, throttle valve position, spark plug ignition timing (for spark-ignition engines), and others. Sensors communicating input through I/O interface 94 may be indicating piston position, engine rotational speed, vehicle speed, coolant temperature, intake manifold pressure, accelerator pedal position, throttle valve position, air temperature, exhaust temperature, exhaust air to fuel ratio, exhaust component concentration, and air flow, for example. Some controller architectures do not contain an MMU 86. If no MMU 86 is employed, CPU 84 manages data and connects directly to ROM 88, RAM 90, and KAM 92. Of course, the present invention could utilize more than one CPU 84 to provide engine control and controller 80 may contain multiple ROM 88, RAM 90, and KAM 92 coupled to MMU 86 or CPU 84 depending upon the particular application.

In the embodiment illustrated in FIG. 1, controller 80 may control engine intake and exhaust valves 30 indirectly via valve controller 70. For example, engine controller 80 may provide commands to control intake and/or exhaust valve timing and phasing that are communicated to valve controller 70. Control logic 72, which may be implemented in hardware, software, or a combination of hardware and software, then controls the corresponding valve actuator(s) to implement the command in accordance with the present invention as described in greater detail below.

Figure 2:
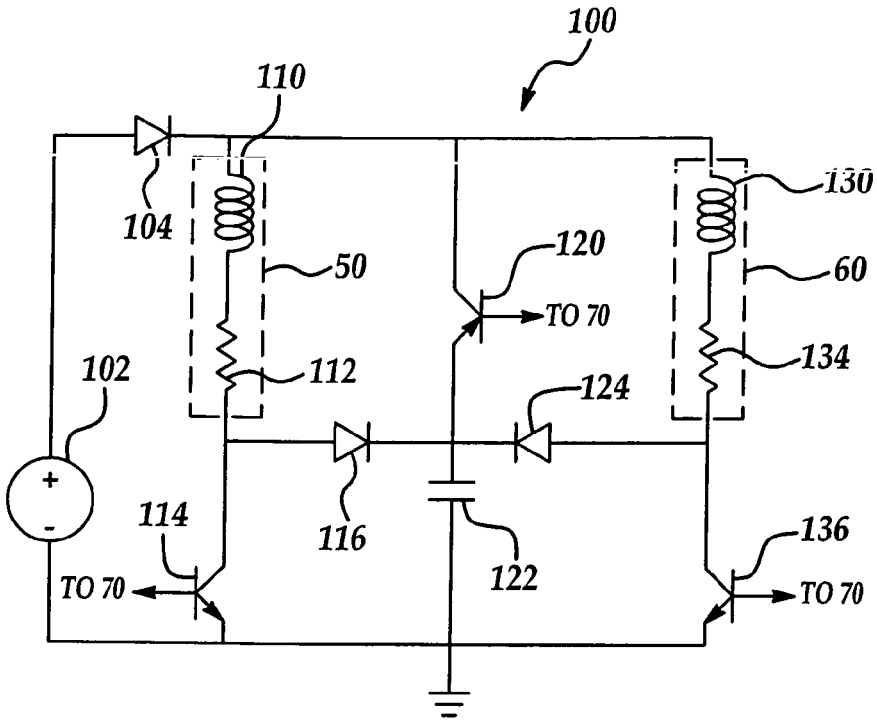
FIG. 2 is a simplified circuit schematic illustrating one embodiment of a system or method for valve actuation according to the present invention.

A simplified circuit schematic for valve actuation according to one embodiment of the present invention is illustrated in FIG. 2. Those of ordinary skill in the art will appreciate that various components illustrated in the simplified circuit schematic may be replaced by one or more other components having a similar function. As such, the simplified schematic generally represents a variety of application-specific implementations consistent with the teachings of the present invention.

Depending on the control design, power supply 102 generally represents any of a variety of power supplies that may be controlled to provide a desired output of either voltage or current. In the embodiment described, power supply 102 is a voltage regulated switching power supply. Preferably, power supply 102 is a current regulated switching power supply. Power supply 102 may be directly or indirectly connected to a vehicle battery, valve actuator system battery, or other power source depending upon the particular application. Power supply 102 is connected to a diode 104 to limit flow of current back through power supply 102. The coils of upper electromagnet 50 and lower electromagnet 60 of a valve actuator assembly 10 are connected to power supply 102 through supply diode 104. Upper electromagnet coil 50 is represented by an inductive load 110 and resistive load 112, while lower electromagnet coil 60 is represented by an inductive load 130 and resistive load 134. Upper electromagnet coil 50 is selectively connected to ground through a controllable switching device 114, such as a transistor or SCR, for example, and through a storage diode and capacitor 122, which functions as an energy storage device in this embodiment. Depending upon the particular application and implementation, various other energy storage devices, including an inductive or magnetic storage devices may be used alone or in combination.

Lower electromagnet coil 60 is similarly selectively connected to ground through a controllable switching element illustrated as transistor 136 and through a second storage diode 124 and capacitor 122. Capacitor 122 is selectively coupled to upper electromagnet coil 50 and lower electromagnet coil 60 through regenerating transistor 120 which functions as a controllable switching device. As those of ordinary skill in the art will appreciate, the controllable switching devices 114, 120, and 136 are connected directly or indirectly to a controller, such as valve controller 70 (FIG. 1) that generates appropriate trigger signals to allow current to flow through the device or to block substantially all current.

Operation of the simplified circuit illustrated in FIG. 2 will now be described for a representative valve opening event that does not incorporate a velocity controller to remove any lash between the armature shaft 18 (FIG. 1) and the valve stem. For the initial state (valve closed), transistor 114 is "on" (conducting current) and transistors 120 and 136 are "off" (blocking current). Power supply 102 is controlled to provide a voltage sufficient to provide holding current through supply diode 104, upper coil 50, and transistor 114 to energize upper coil 50 and hold the valve closed against the spring force. During the launch phase of the opening event, transistor 114 is turned "off" with an appropriate trigger signal from valve controller 70 so that energy stored in upper electromagnet coil 50 is transferred to capacitor 122 through diode 116 pumping capacitor 122, which may reach voltages of between 200V and 1100V, for example, with a 24V power supply. Current is blocked by transistor 120 ("off") and by diode 124. As the magnetic force generated by upper coil 50 decays, spring force begins to move armature 16 (FIG. 1) across the gap toward lower electromagnet coil 60. According to the present invention, transistor 136 may be energized and power supply 102 controlled to begin providing power to lower coil 60 while the armature is traversing the gap. Preferably, power supply 102 and transistor 136 are controlled to provide sufficient energy to lower coil 60 to compensate for various system losses, which may include electrical, mechanical, and friction losses, and work to overcome gas pressure forces within an associated combustion chamber or cylinder. As the armature approaches the lower electromagnet coil 60 and compresses the associated spring 42 (FIG. 1), power supply 102 continues to be controlled to provide current to lower coil 60 while transistor 120 is turned "on" (conducting) to transfer energy stored in capacitor 122 to lower coil 60 to catch the armature and land the valve. Transistor 120 is then turned off and power supply 102 is controlled to provide a holding current to hold the armature and valve in the open position against the spring force. Typically, the holding current is smaller than the catching current as described in greater detail below.

The process described above is then reversed to close the valve. In particular, transistor 136 is turned "off" to transfer stored energy to capacitor 122. Transistor 114 is turned "on" during flight of the armature across the gap to prepare for the energy transfer from capacitor 122. Transistor 120 is then turned "on" when the armature is within a catch zone to attract and catch the armature.

Some applications may have a gap or "lash" between the armature shaft that pushes on the valve stem to open the valve and the valve stem. For these applications, when the valve is closed, direct use of the current catcher illustrated in the simplified schematic of FIG. 2 may result in noise, vibration, and harshness (NVH) issues during armature launch when the armature shaft contacts the valve stem. As such, a velocity controller may be used to control the power supply voltage or current to the upper coil to launch the armature across the valve lash gap during the valve opening. Once the lash landing has taken place softly, then the current catcher may be triggered to quickly quench the current and transfer the remaining energy to an energy storage device for use during the valve landing as described above.

As illustrated in FIG. 2 and described in greater detail below, the present invention selectively couples (and decouples) the energy storage device (a capacitor in this embodiment) to the electromagnet coils to allow the current into the catching coil to be controlled during a valve opening or closing event.

Figure 3:
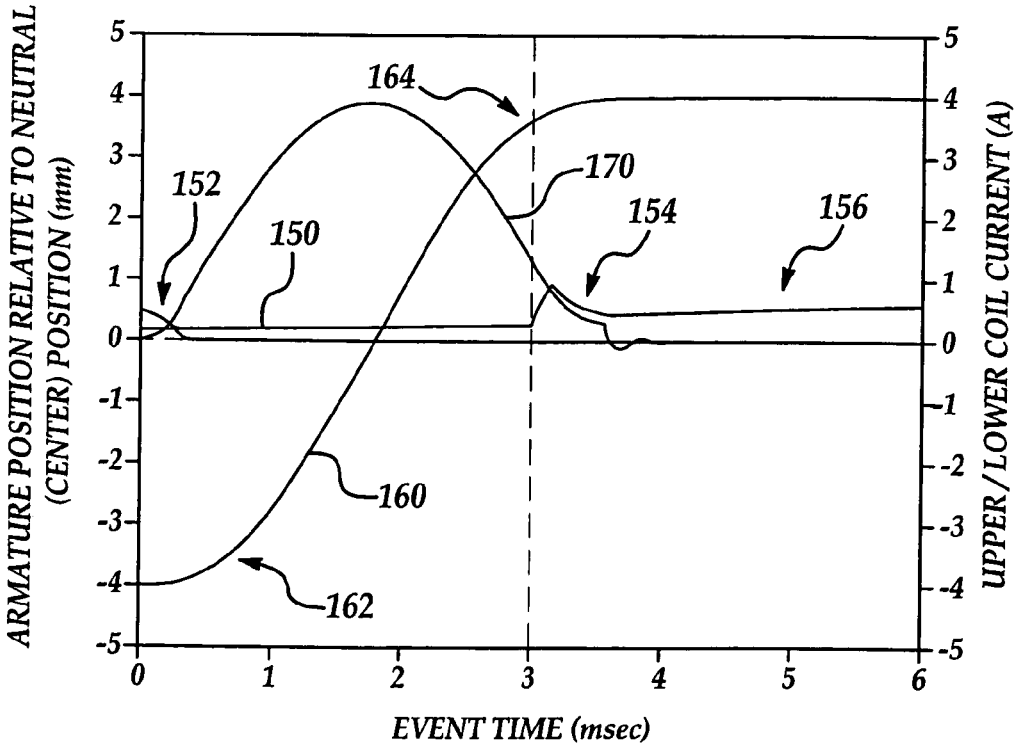
FIG. 3 is a plot illustrating armature position, armature velocity, and coil current as determined by simulation of a circuit for controlling valve actuation according to one embodiment of the present invention.

FIG. 3 is a plot illustrating armature position, armature velocity, and coil current during a representative valve opening or closing event as determined by simulation of a simplified circuit for controlling valve actuation according to one embodiment of the present invention. In the plot of FIG. 3, line 150 represents coil current, line 160 represents armature position relative to a neutral or center position approximately equidistant between the upper and lower electromagnet coils, and line 170 represents the armature velocity as the armature moves between the two opposing coils.

The initial conditions represent the armature being held by the lower electromagnet coil (valve open) at a position of about 4 millimeters (mm) from the neutral position. The initial armature velocity is zero and the initial holding current is about 0.445 amperes (A). During the launch phase, energy stored in the lower electromagnet coil is quickly transferred to an energy storage device (a 0.06 microfarad capacitor in this simulation) as indicated by the rapid decrease in current at 152. The armature begins to move away from the lower electromagnet coil as indicated at 162 with increasing velocity that peaks as the armature passes through the neutral position as indicated by line 170. The armature velocity slows as the armature approaches the catching zone within about 1 millimeter (mm) of the upper electromagnet indicated at 164 where the energy stored in the energy storage device is delivered to the coil to provide the catching current corresponding to about 42 volts (V) indicated at 154. A holding current is then provided for the catching coil as generally represented at 156.

Figure 4:
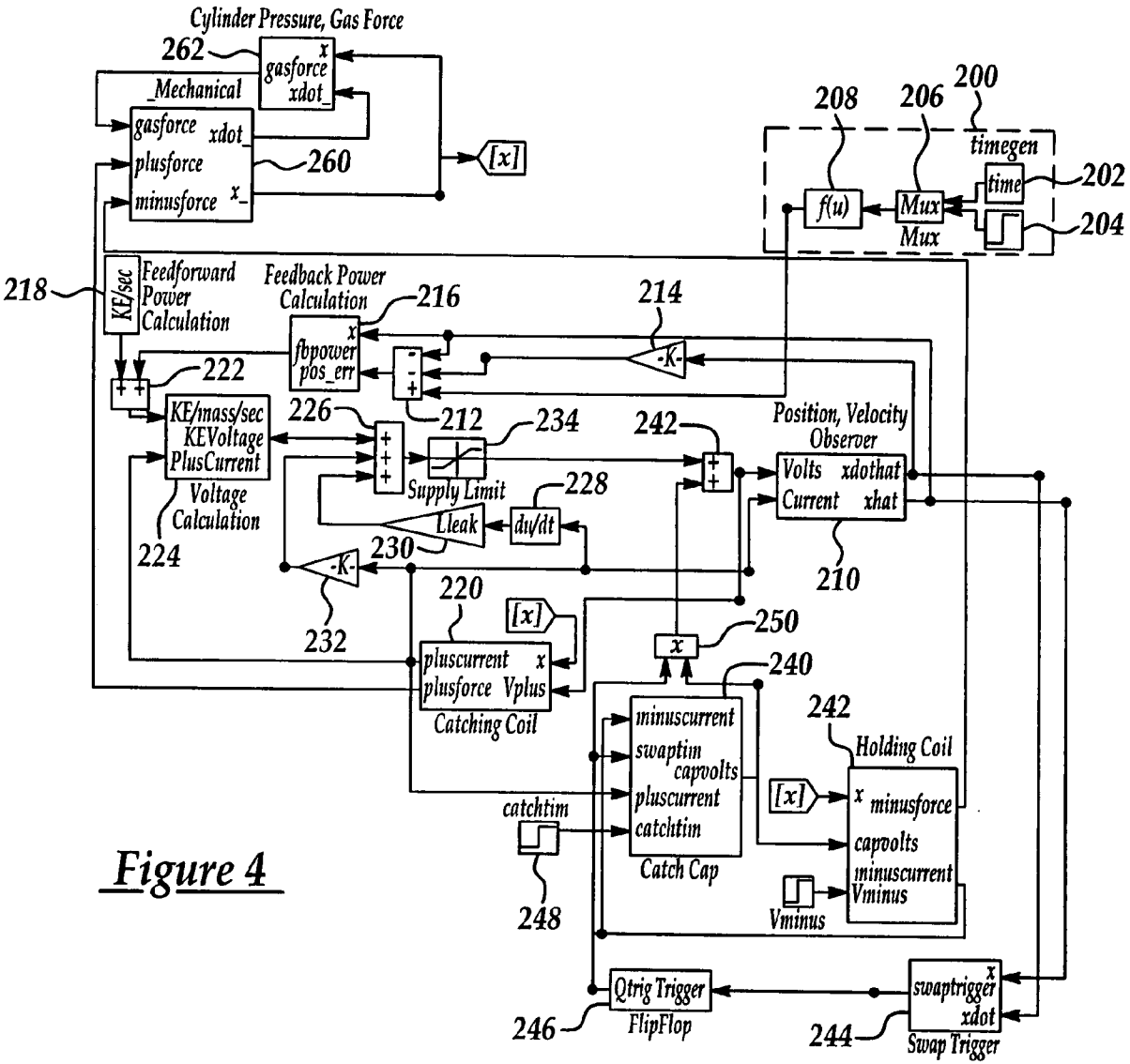
FIG. 4 is a block diagram representing a valve actuator and control system according to one embodiment of the present invention.

FIG. 4 is a block diagram representing a valve actuator and control system for actuating an exhaust valve for an internal combustion engine according to one embodiment of the present invention. While the block diagram of FIG. 4 has been used to model and simulate operation of a valve actuator and control system for an engine exhaust valve, those of ordinary skill in the art will recognize that the teachings of the present invention are equally applicable to engine intake valves, which are generally easier to control because of the lower and more predictable cylinder pressures experienced during this part of engine cylinder operation. Similarly, those of ordinary skill in the art will appreciate that the representative control system illustrated may be implemented with a wide variety of hardware and/or software using well-known principles of control system design. Of course, the illustrated model and/or associated parameters may be modified based on the particular valve, actuator, engine, and/or controller consistent with the teachings of the present invention, i.e. selective switching of an energy storage device to decouple armature flight control from the armature launch and catch facilitating energy injection control to compensate for expected work and losses over the opening/closing event. As illustrated in FIG. 4, the present invention uses proportional position feedback energy injection control with feedback provided by a voltage-current based position/velocity estimator in combination with feedforward energy injection to compensate for expected gas force and damping work. Feedback linearization is used to control the applied coil voltage. The present invention recognizes that flux linkages in the valve actuators are a conserved quantity, like momentum, and uses a voltage driven flux-based model of the actuator to develop the control system.

Block 200 of FIG. 4 generates a control signal to initiate a valve opening or closing event. In an actual application, this control signal would typically be initiated by the engine or vehicle controller based on current engine operating conditions. In this simulation, a time-based trigger signal is generated by blocks 202, 204, and 206 to represent steady-state operation of an engine at a selected operating speed (rpm) and is converted to a desired armature position (x) for the corresponding valve actuator by a function (f(u)) as represented by block 208. The desired armature position (x) is used in combination with estimated actual armature position (x-hat) feedback generated by a position and velocity observer 210 to eliminate the need for a physical position transducer. The position feedback generated by observer 210 based on the current and voltage of catching coil 220 in combination with an estimated actual armature velocity (x-dot-hat) adjusted by gain 214 to provide extra damping for feedback linearization, is used to generate a position deviation or error at block 212. A proportional controller represented by block 216 determines the energy or power injection required to reduce the position error determined by block 212. The feedback power calculation inherently compensates for various system losses that may include mechanical, electrical and magnetic losses, for example. The feedback power is combined at 222 with a feedforward energy or power that compensates for expected gas force and damping work associated with opening the valve against a variable cylinder pressure as represented by block 218. In one embodiment, the model assumes isothermal, isovolumetric cylinder blowdown with an adjustable initial temperature, volume, pressure, and gas force coefficients. Various published and validated models may be used to provide an appropriate feedforward power calculation depending upon the particular application.

The required feedforward and feedback energy are converted to a required voltage based on the current (plus-current) from the catching coil 220 as represented by block 224. The required voltage may be adjusted at block 226 to compensate for leakage inductance based on the catching coil current as calculated by blocks 228, 230, and 232. The adjusted or modified voltage required may be limited by the capabilities of the power supply as represented by block 234. The power supply is then controlled to provide the required voltage (subject to the supply limit) to the catching coil 220. Additional energy is selectively provided to catching coil 220 from catching capacitor 240 (or other energy storage device) as represented by block 242. As described above, catching capacitor 240 is selectively switched as represented by blocks 244, 246, 248, and 250 to quickly quench and capture energy stored in holding coil 242, and then isolated from catching coil 220 during flight of the armature across the gap to allow energy injection control, and subsequently coupled to catching coil 220 to transfer the stored energy to catch the armature.

The mechanical dynamics of the actuator assembly are modeled as represented generally by block 260. In various embodiments, the actuator is modeled as a lumped mass-spring-damper without lash incorporating additional spring and damping forces to simulate armature bounce. A two mass model incorporating lash, or various other types of models may be used depending upon the particular application and implementation. The cylinder pressure and gas force dynamics are modeled as represented generally by block 262 based on an isothermal, isovolumetric cylinder blowdown with various adjustable parameters. As previously described, the present invention is independent of the particular model and/or parameters used and will vary depending upon the particular application and implementation of the actuator assembly, valve, engine, etc.

Figure 5:
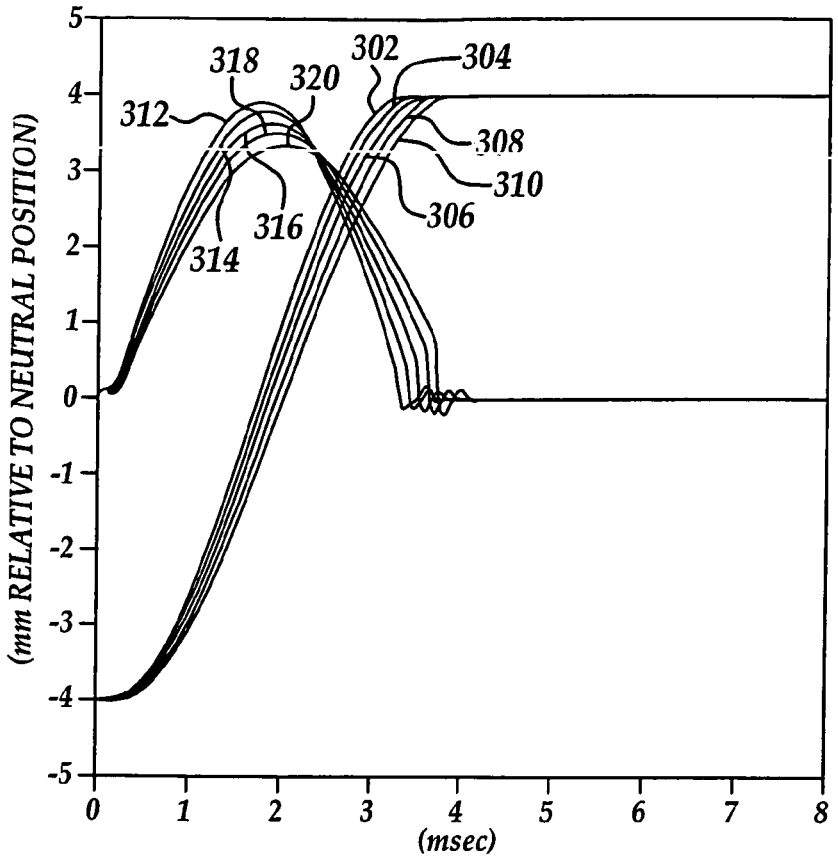
FIG. 5 is a plot illustrating simulated operation of the control system embodiment of FIG. 4 for various exhaust pressures according to the present invention.

FIG. 5 is a plot illustrating simulated operation of the control system embodiment of FIG. 4 for an exhaust valve opening event under various exhaust pressures and a constant energy injection rate according to the present invention. The plot of FIG. 5 illustrates armature position and velocity as a function of time for differential pressures across the exhaust valve corresponding to 0-4 atm as represented by armature position lines 302–310, respectively, and armature velocity lines 312–320, respectively. The armature position is measured relative to a neutral position between the holding and catching coils ranging from about −4 mm (millimeters) to +4 mm (millimeters).

Figure 6:
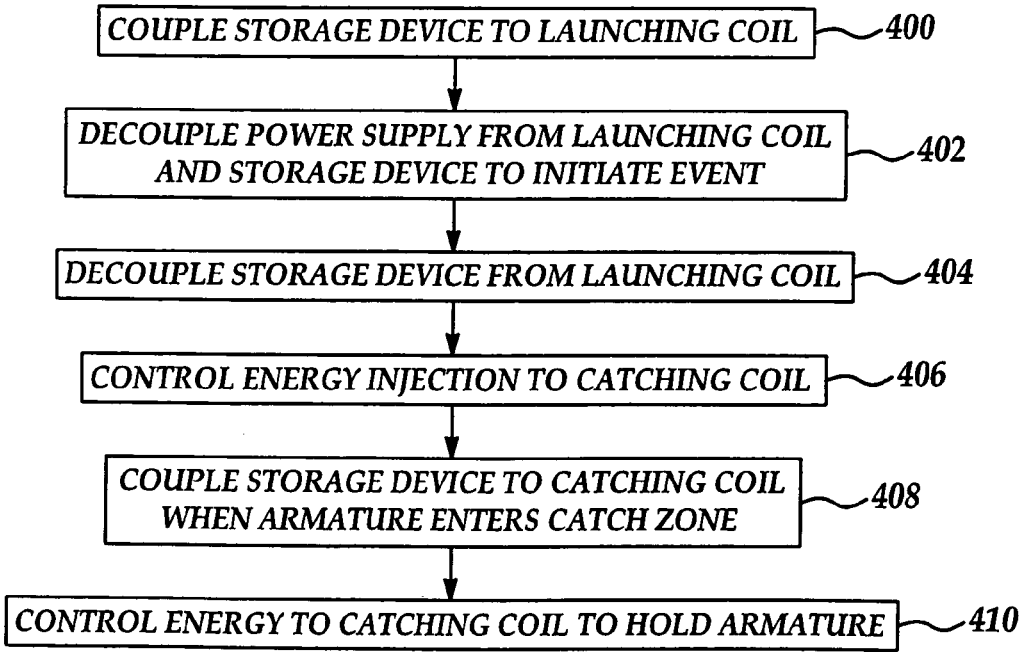
FIG. 6 is a flow chart illustrating operation of a system or method for valve actuation according to one embodiment of the present invention.

FIG. 6 is a flow chart illustrating operation of a system or method for valve actuation according to one embodiment of the present invention. The diagram of FIG. 6 generally represents control logic for one embodiment of a system or method according to the present invention. As will be appreciated by one of ordinary skill in the art, the diagram may represent any one or more of a number of known processing strategies such as event-driven, interrupt-driven, multi-tasking, multi-threading, and the like. As such, various steps or functions illustrated may be performed in the sequence illustrated, in a modified sequence, in parallel, or in some cases omitted. Likewise, the order of operation or processing is not necessarily required to achieve the objects, features, and advantages of the invention, but is provided for ease of illustration and description. Although not explicitly illustrated, one of ordinary skill in the art will recognize that one or more of the illustrated steps or functions may be repeatedly performed depending upon the particular application and processing strategy being used. Preferably, the control logic is implemented primarily in software executed by a microprocessor-based engine controller. Of course, the control logic may be implemented in software, hardware, or a combination of software and hardware depending upon the particular application. When implemented in software, the control logic is preferably provided in a computer-readable storage medium having stored data representing instructions executed by a computer to control one or more components of an internal combustion engine. The computer-readable storage medium or media may be any of a number of known physical devices which utilize electric, magnetic, and/or optical devices to temporarily or persistently store executable instructions and associated calibration information, operating variables, and the like.

As represented by block 400 of FIG. 6, a system or method according to the present invention selectively couples an energy storage device to a launching coil of the valve actuator and decouples the power supply from the launching coil and energy storage device to initiate the valve opening or closing event as represented by block 402. This allows transfer of energy stored in the launching coil (and associated spring(s) if present) to the energy storage device and allows the power supply to be controlled during the event to provide appropriate energy to the catching coil over the course of the event.

The energy storage device is subsequently decoupled from the launching coil as represented by block 404 in preparation for coupling to the catching coil. As the armature travels toward the catching coil, the power supply is controlled, preferably using a proportional armature position feedback control with feedforward compensation for expected gas force and damping work, to supply sufficient energy to the catching coil to complete the event in a controlled manner. As the armature approaches the catching coil and enters a catching region or zone, the energy storage device is coupled to the catching coil to transfer the stored energy from the energy storage device to the catching coil and complete the event as represented by block 408. The power supply is then controlled to provide sufficient energy to the catching coil to hold the armature against the second coil until the next opening or closing event as represented by block 410.

The process is then reversed to close/open the valve as described in greater detail above with reference to FIG. 2.

While the best mode for carrying out the invention has been described in detail, those familiar with the art to which this invention relates will recognize various alternative designs and embodiments for practicing the invention as defined by the following claims.

What is claimed:

1. A method for controlling an internal combustion engine having a plurality of cylinders each having at least one intake and exhaust valve with at least one of the valves being operated by an electromagnetic actuator having an armature connected to the valve and traveling between first and second coils to open and close the valve in response to a control signal from an actuator control, the actuator control including a power supply and an energy storage device, the method comprising:

decoupling the power supply from the first coil and the energy storage device; and selectively coupling and decoupling the energy storage device from the first and second coils to control power supplied to the second coil as the armature travels between the first and second coils.

2. The method of claim 1 further comprising controlling the power supply to control the power supplied to the second coil.

3. The method of claim 2 wherein the step of controlling the power supply comprises controlling current supplied to the second coil.

4. The method of claim 3 wherein the step of controlling current comprises controlling current to compensate for system losses.

5. The method of claim 3 wherein the step of controlling current comprises controlling current to provide a desired valve landing velocity.

6. The method of claim 2 wherein the step of controlling the power supply comprises controlling the power supply based on armature position feedback.

7. The method of claim 6 further comprising determining armature position based on voltage and current of the second coil.

8. The method of claim 2 wherein the step of controlling the power supply comprises controlling the power supply based on armature velocity feedback.

9. The method of claim 8 further comprising determining armature velocity based on voltage and current of the second coil.

10. The method of claim 1 further comprising controlling coupling of the energy storage device to the second coil to control valve landing velocity.

11. The method of claim 1 further comprising coupling the energy storage device to the second coil to transfer stored energy from the energy storage device to the second coil as the armature enters a catch zone associated with the second coil.

12. A method for actuating an intake or exhaust valve of an internal combustion engine using an electromagnetic valve actuator having an armature connected to the valve and traveling across a gap between first and second coils to open and close the valve, the method comprising:

controlling energy in the first coil to launch the valve;

decoupling a power supply from the first coil and storing energy in an energy storage device as the armature moves away from the first coil;

coupling the power supply to the second coil to control flight of the armature across the gap; and coupling the energy storage device to the second coil to catch the armature during landing of the valve.

13. The method of claim 12 wherein the step of controlling energy in the first coil comprises controlling the power supply to remove any lash between the valve and an associated armature shaft.

14. The method of claim 13 wherein the power supply is controlled to remove lash only during valve opening events.

15. The method of claim 14 further comprising coupling the first coil to the energy storage device only after any lash between the valve and an associated armature shaft is removed.

16. The method of claim 12 wherein the step of controlling energy in the first coil comprises coupling the first coil to the energy storage device to launch the valve.

17. A system for operating an electromagnetic valve actuator having first and second coils, the system comprising:

a first switching element connected to the first coil for selectively coupling the first coil to ground;

a second switching element connected to the second coil for selectively coupling the second coil to ground;

an energy storage device;

a third switching element connected to the energy storage device for selectively coupling the energy storage device to the first and second coils;

a first diode connected to allow current flow from the first coil to the energy storage device; and a second diode connected to allow current flow from the second coil to the energy storage device.

18. The system of claim 17 wherein at least one of the first, second, and third switching elements comprises a transistor.

19. The system of claim 17 wherein at least one of the first, second, and third switching elements comprises an SCR.

20. The system of claim 17 further comprising:

a supply diode connected to allow current to flow from a power supply to the first and second coils.

21. The system of claim 17 further comprising:

a controllable power supply; and a controller in communication with the power supply and the first, second, and third switching elements, the controller generating signals for the first, second, and third switching elements to selectively decouple the energy storage device from the power supply, couple the energy storage device to the first coil, decouple the power supply from the first coil, couple the power supply to the second coil and control the power supply as the armature travels toward the second coil, and couple the energy storage device to the second coil when the armature is within a catching range of the second coil.

22. The system of claim 21 wherein the controller controls the power supply based on position of the armature.

23. The system of claim 21 wherein the controller controls the power supply based on velocity of the armature.

24. The system of claim 21 wherein the controller determines position of the armature based on at least one parameter associated with the second coil.

25. The system of claim 24 wherein the at least one parameter includes voltage and current.

26. The system of claim 21 wherein the controller controls the power supply using a feedforward term based on work to overcome gas forces within an engine cylinder.

27. A computer readable storage medium having stored data representing instructions executable by a computer to control an electromagnetic valve actuator having an armature that travels between first and second coils to actuate a valve for an internal combustion engine the computer readable storage medium comprising:

instructions for controlling a plurality of switching elements to selectively couple and decouple an energy storage element from the first and second coils and the power supply to store energy from the first coil in the energy storage device at the beginning of valve actuation, cool the power supply based on armature position during valve actuation, and supply energy from the energy storage device to the second coil when the armature is within a catching region of the second coil.

28. The computer readable storage medium of claim 27 further comprising instructions for determining armature position based on at least one parameter of the second coil.

29. The computer readable storage medium of claim 28 wherein the at least one parameter includes voltage.

30. The computer readable storage medium of claim 28 wherein the at least one parameter includes current.

* * * * *